US007102087B2

(12) United States Patent
Chun et al.

(10) Patent No.: US 7,102,087 B2
(45) Date of Patent: Sep. 5, 2006

(54) KEY TOP

(75) Inventors: Gyu-chul Chun, Iksan-shi (KR); Young-choon Lee, Jeonju-shi (KR); Hee-jun Kim, Iksan-shi (KR)

(73) Assignee: SMK Korea Co., LTD, Oksan-shi (KR)

( * ) Notice: Subject to any disclaimer, the term of this patent is extended or adjusted under 35 U.S.C. 154(b) by 0 days.

(21) Appl. No.: 10/974,325

(22) Filed: Oct. 27, 2004

(65) Prior Publication Data

US 2005/0133356 A1 Jun. 23, 2005

(30) Foreign Application Priority Data

Oct. 28, 2003 (KR) ..... 10-2003-0075450

(51) Int. Cl.
*H01H 9/00* (2006.01)

(52) U.S. Cl. ..... 200/5 A; 200/345; 200/302.1

(58) Field of Classification Search ..... 200/5 A, 200/17 R, 302.1, 320.2, 345, 520
See application file for complete search history.

(56) References Cited

U.S. PATENT DOCUMENTS 5,396,038 A * 3/1995 Yamada ..... 200/517
5,726,400 A * 3/1998 Masuda ..... 200/160

* cited by examiner

*Primary Examiner*—Richard K. Lee
(74) *Attorney, Agent, or Firm*—Omori & Yaguchi USA, LLC

(57) ABSTRACT

A key top comprising a key stem provided at a lower portion of the key top to be inserted into a rubber cup unit; and a first spring provided at a lower end of the key stem, and comprising a plate spring, wherein the key top is pushed down by finger pressure to turn on a contact point, thus executing key-in operation.

7 Claims, 11 Drawing Sheets

KEY TOP

PRIORITY FILING

This application claims foreign priority benefits from co-pending Korean Patent Application No. 10-2003-0075450 entitled "Key Top", filed on Oct. 28, 2003.

BACKGROUND OF THE INVENTION

1. Field of the Invention

The present invention relates generally to key tops, and more particularly, to a key top which has a dust-proof design and superior sliding action.

2. Description of the Related Art

As well known to those skilled in the art, a key top is a part of each key switch constituting a keyboard. When a key cap of the key switch is pushed down by an operator's finger, the key top attached to the bottom of the key cap is moved down by finger pressure to turn on a contact point of a flexible printed circuit (FPC), thus realizing key-in operation.

A conventional key top is shown in FIG. 1.

In FIG. 1, the reference numeral 1 denotes a key top. The key top 1 is provided to correspond to each key on a keyboard. A key stem 12 extends downward from a central portion of a lower surface of the key top 1. Stoppers 11 are provided at predetermined positions on the lower surface of the key top 1. The reference numeral 2 denotes a housing, and a guide hole 21 is formed at a predetermined position on the housing 2 to guide the key stem 12. The reference numeral 3 denotes a rubber cup, with a protrusion 31 provided on a lower surface of the rubber cup 3. The reference numeral 4 denotes an FPC having at a predetermined position thereof a contact point 41. The reference numeral 5 denotes a frame.

In a key switch constructed as described above, when the key top 1 is depressed by an operator's finger, the key top 1 moves downward while being guided by the guide hole 21. At this time, the key stem 12 moves downward together with the key top 1, thus pressing down the rubber cup 3. Further, the protrusion 31 of the rubber cup 3 pushes down the contact point 41, so that a key is switched to an ON state.

However, the key switch is problematic in that impurities, such as dust, may enter the guide hole 21 for guiding the key stem 12, thus hindering smooth sliding motion of the key stem 12. Also, during operation of a computer, coffee, water or the like may flow into the guide hole 21, with the result that the smooth sliding motion of the key stem 12 may be hindered. Further, when coffee, water or the like flows to the contact point 41, failure of key-in operation occurs.

The key switch has a disadvantage in that noise is generated when the stoppers 11 come into contact with the housing 2 in the course of the downward movement of the key top 1.

In order to overcome the drawbacks, a key switch of FIG. 2 was proposed. The key switch is constructed so that a key stem 12 is surrounded with a hollow rubber cup 3, thus preventing impurities, such as dust, from entering the key switch.

However, the key switch includes a spring 13 made of metal. The spring 13 is mounted to a lower surface of the key stem 12 to press the contact point 41. The key stem 12 integrated with a key top 1 is usually made of resin. Thus, the key switch has a problem in that the spring 13 must be separately manufactured and then mounted to the key stem 12, so that the number of assembly processes is undesirably increased.

A multiple key, such as an enter key or a spacebar, is a key that is obtained by combining two or more key switches with each other. That is, one multiple key uses two or more key stems 12. Further, an operator may not press the exact center of the multiple key. For example, when an end of the multiple key is pushed down, the multiple key is tilted by a rotational moment. Thereby, a key stem 12 which is distant from the pushed end of the multiple key may not smoothly slide in the guide hole 21.

In order to solve the problem, there has been proposed a link bar which is mounted to a predetermined position of the multiple key so as to transmit pressure uniformly. However, this method has a problem in that the number of components is increased, so that additional assembly processes are required.

Further, since one multiple key uses two or more rubber cups, the rubber cups for the multiple key must be separately manufactured in order to make pressing sensation of the multiple key equal to that of a single key. That is, it is inconvenient to reduce the elasticity of two rubber cups used in the multiple key so that the total elasticity of the rubber cups for the multiple key is equal to the elasticity of one rubber cup used in a single key.

SUMMARY OF THE INVENTION

A key top has a key stem provided at a lower portion of the key top to be inserted into a rubber cup unit; and a first spring provided at a lower end of the key stem, and having a plate spring, wherein the key top is pushed down by finger pressure to turn on a contact point, thus executing key-in operation.

BRIEF DESCRIPTION OF THE DRAWINGS

The objects, features and other advantages of the present invention will be more clearly understood from the following detailed description taken in conjunction with the accompanying drawings, in which:

FIGS. 3*a* to 3*e* are views to show a key top of a single key, in which FIG. 3*a* is a perspective view of the key top, FIG. 3*b* is a sectional view of the key top, FIG. 3*c* is a sectional view to illustrate operation of the key top of the single key, FIG. 3*d* is a perspective view of a rubber cup unit, and FIG. 3*e* is a perspective view of a housing;

FIGS. 4*a* to 4*g* are views to show a key top of a multiple key, in which FIG. 4*a* is a perspective view of the key top, FIG. 4*b* is a front view of the key top, FIG. 4*c* is a sectional view taken along the line B–B' of FIG. 4*a*, FIG. 4*d* is a sectional view taken along the line C–C' of FIG. 4*a*, FIG. 4*e* is a perspective view of a rubber cup unit, FIG. 4*f* is a perspective view of a housing, and FIG. 4*g* is a sectional view to illustrate operation of the key top;

FIGS. 5*a* to 5*c* are views to show contact surfaces of the key top of the multiple key, in which FIG. 5*a* is a sectional view to show the case where a lower portion of a center of a contact surface is flat, FIG. 5*b* is a sectional view to show the case where a lower portion of a center of a contact surface is downwardly convex, and FIG. 5*c* is a sectional view to illustrate the interaction between the contact surface and the rubber cup unit;

DESCRIPTION OF THE PREFERRED EMBODIMENTS

Figure 1:
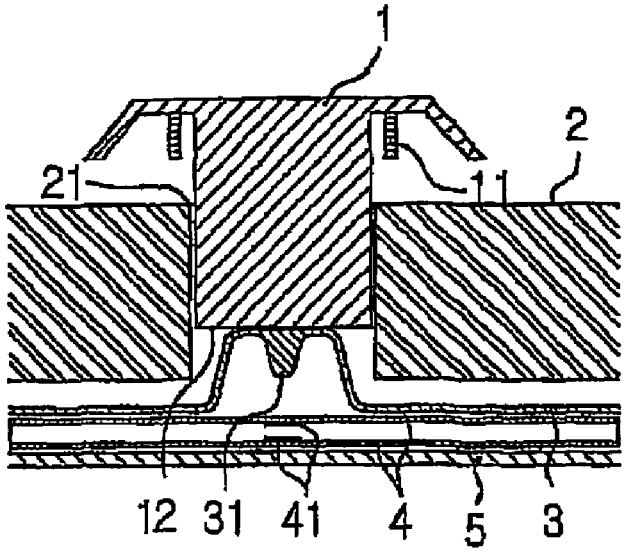
FIG. 1 is a sectional view to show a conventional key switch with a key top.
Figure 2:
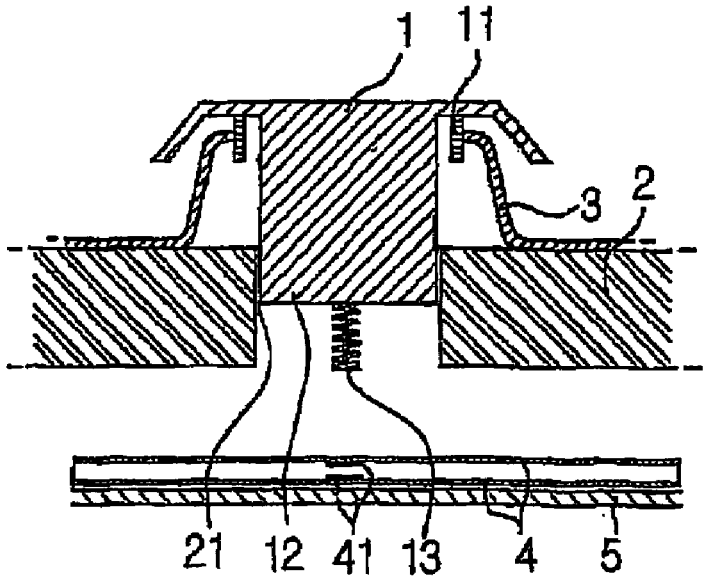
FIG. 2 is a sectional view to show another conventional key switch with a key top.

The present invention has been made keeping in mind the above problems occurring in the prior art, and an object of the present invention is to provide a key top which has a simple structure.

Another object of the present invention is to provide a key top which is capable of reducing noise when using a key switch.

A further object of the present invention is to provide a key top which allows key stems to smoothly slide, even when the key top is applied to a multiple key.

Yet another object of the present invention is to provide a key top which enables a single key and a multiple key to have an identical pressing sensation, although identical rubber cup units are used in the single key and the multiple key.

The present invention, for accomplishing the above and other objects, will be described in detail with reference to the attached drawings, showing its various embodiments.

Reference now should be made to the drawings, in which the same reference numerals are used throughout the different drawings to designate the same or similar components.

A key top of a single key and a key top of a multiple key according to the present invention will be described hereinafter.

Figure 3A:
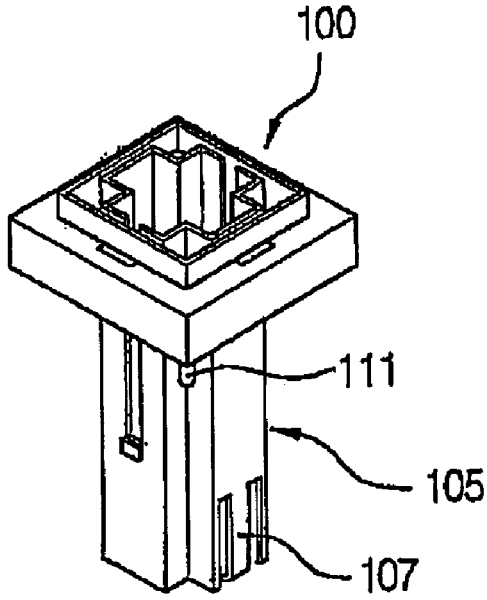
Figure 3B:
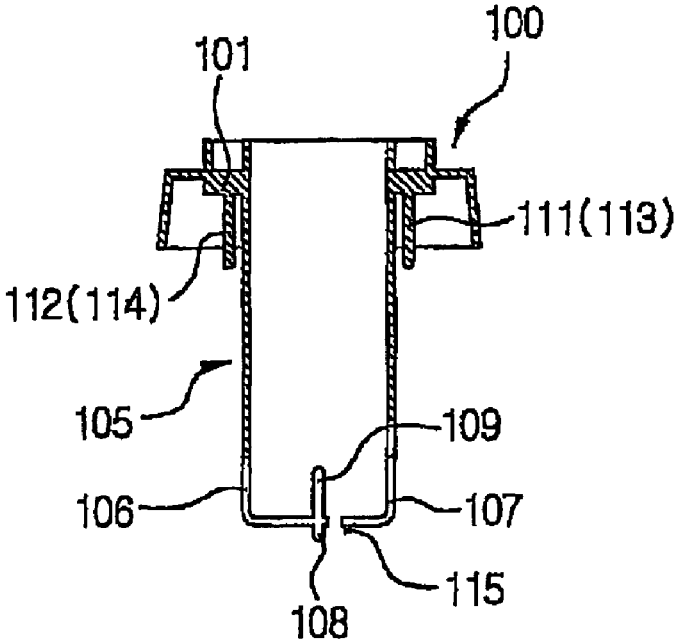
Figure 3C:
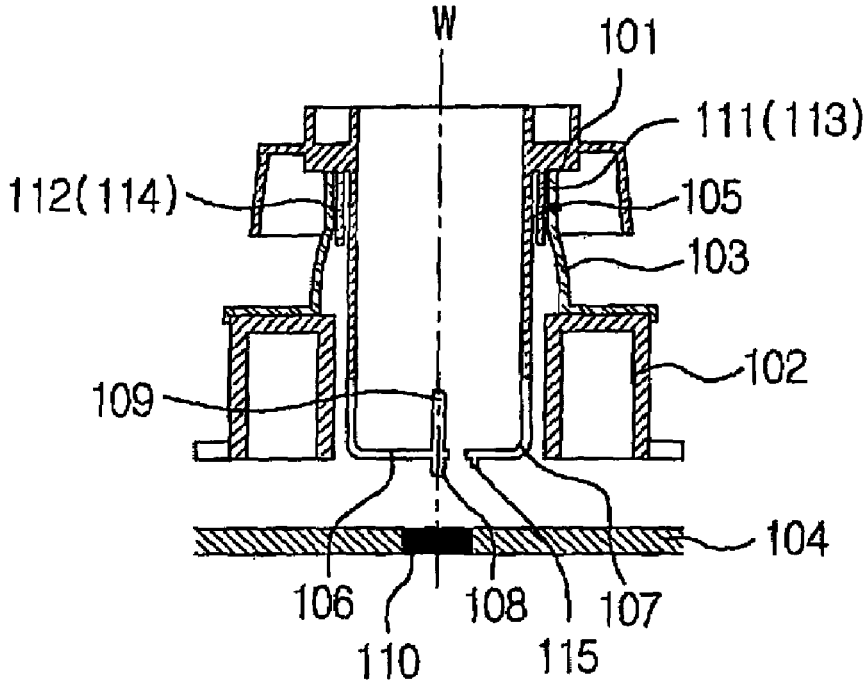
Figure 3D:
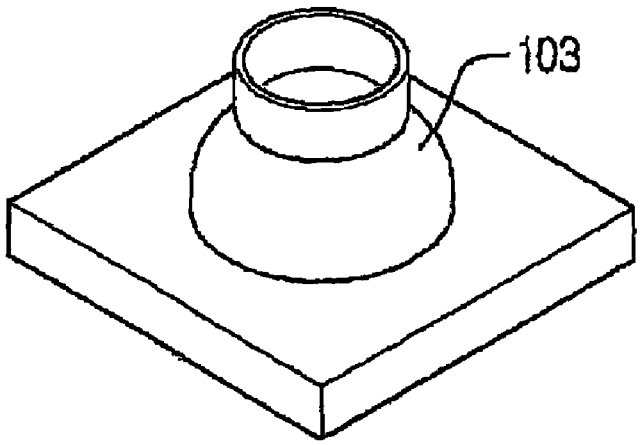
Figure 3E:
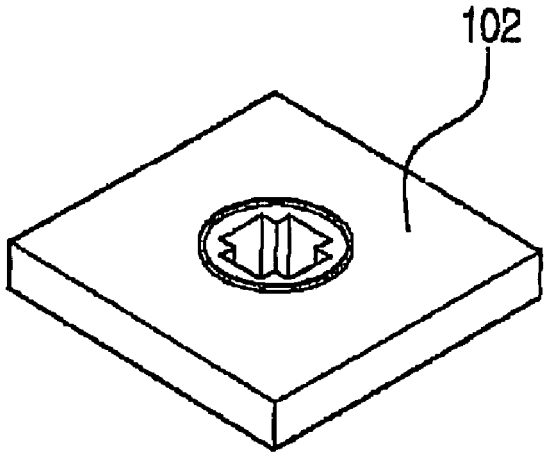

A key top 100 of the single key is described with reference to FIGS. 3*a* to 3*e*. FIGS. 3*a* to 3*e* are views to show the key top of the single key, in which FIG. 3*a* is a perspective view of the key top, FIG. 3*b* is a sectional view of the key top, FIG. 3*c* is a sectional view to illustrate operation of the key top of the single key, FIG. 3*d* is a perspective view of a rubber cup unit, and FIG. 3*e* is a perspective view of a housing.

First, the key top 100 of the single key will be described in detail.

The key top 100 of the single key is manufactured to correspond to a key cap (not shown). In a detailed description, an opening is formed at a center on an upper surface of the key top 100 to correspond to a shape of a lower portion of the key cap, thus receiving the lower portion of the key cap. Further, a contact surface 101 is provided at a position around the opening of the key top 100.

A key stem 105 extends downward from the contact surface 101 to be integrated with the contact surface 101, and has a shape of a box which is open at a lower surface thereof. Further, a first spring 106 comprising a plate spring is provided at a lower portion of a sidewall of the key stem 105, while a second spring 107 comprising a plate spring is provided at a lower portion of a sidewall opposite the sidewall with the first spring 106. Each of the first and second springs 106 and 107 is bent at a lower end of the key stem 105 toward a central axis W of the key top 100 at an angle of about 90°. As shown in FIG. 3*c*, an upper protrusion 109 extending upward from an end of the first spring 106 and a first lower protrusion 108 extending downward from the end of the first spring 106 are integrally provided at the end of the first spring 106 such that they are aligned with the central axis W of the key top 100. Further, a second lower protrusion 115 extends downward from an end of the second spring 107 to be integrated with the second spring 107. In this case, the second lower protrusion 115 has a smaller size than the first lower protrusion 108. Further, the end of the first spring 106 and the end of the second spring 107, which are positioned at the lower portion of the key stem 105, are spaced apart from each other at a predetermined interval, thus preventing the first spring 106 and the second spring 107 from interfering with each other. Thereafter, an FPC 104 is installed such that a contact point 110 of the FPC 104 is roughly aligned with the central axis W of the key top 100. In such a state, when pressure is transmitted from the key cap to the key top 100, the first lower protrusion 108 comes into contact with the contact point 110 of the FPC 104 by the elasticity of the first spring 106, thus realizing key-in operation.

Further, a rubber cup unit 103 and a housing 102 function to receive the key stem 105 of the key top 100. The key stem 105 of the key top 100 passes through the rubber cup unit 103 and the housing 102 to be movable in a vertical direction. In a detailed description, as shown in FIG. 3*e*, an opening is formed on an upper surface of the housing 102, and has a slightly larger size than the key stem 105 of the key top 100 to allow the key stem 105 to be movable through the housing 102. Further, an inside wall extends downward from the opening of the housing 102.

Further, the rubber cup unit 103 is made of a material with elasticity, and seated on the upper surface of the housing 102. As shown in FIG. 3*d*, a circular opening is formed at a predetermined position of the rubber cup unit 103 to allow the key stem 105 of the key top 100 to move through the rubber cup unit 103. A hollow rubber cup integrally extends upward from a position around the circular opening. An upper edge of the rubber cup is in contact with the contact surface 101. Further, a lower portion of the rubber cup is larger in diameter than an upper portion thereof, and a middle portion is obliquely provided to couple the lower portion to the upper portion of the rubber cup.

Rod-shaped stoppers 111, 112, 113, and 114 are provided at each of the four corners of the key stem 105, respectively, to protrude downward from the contact surface 101 in a vertical direction. A vertical length of each of the stoppers 111 to 114 is determined to allow the first lower protrusion 108 to come into contact with the contact point 110 of the FPC 104, thus ensuring smooth key-in operation, when the key top 100 moves downward so that the stoppers 111 to 114 are in contact with the housing 102. The reason why the length of each of the stoppers 111 to 114 is determined as described above is as follows. That is, if each of the stoppers 111 to 114 is excessively long, the first lower protrusion 108 is not in contact with the contact point 110 of the FPC 104 even when the stoppers 111 to 114 come into contact with the housing 102. Conversely, if each of the stoppers 111 to 114 is excessively short, the first or second lower protrusion 108 or 115 comes into contact with the FPC 104 before the stoppers 111 to 114 contact the housing 102, thus causing damage to several parts of the key top 100.

Therefore, each of the stoppers 111 to 114 must have a predetermined length. In this case, although an operator presses down the key cap and an excessively high load is undesirably applied to the key cap, the stoppers 111 to 114 absorb the high load while contacting the housing 102. Thereby, the stoppers 111 to 114 prevent a high load from being applied to the first and second springs 106 and 107, thus protecting the parts of the key top 100.

The operation of the key top 100 of the single key will be described below with reference to FIG. 3*c*.

When an operator presses down the key cap (not shown), the finger pressure is transmitted from the key cap through the contact surface 101 of the key top 100 to the rubber cup of the rubber cup unit 103. At this time, the rubber cup unit 103 is compressed, thus allowing downward movement of the key top 100. Thus, the first lower protrusion 108 comes into contact with the contact point 110 of the FPC 104, so that the key-in operation is executed. At this time, part of the pressure is absorbed by elasticity of the first spring 106. Subsequently, the second lower protrusion 115 of the second spring 107 comes into contact with the FPC 104, so that the rest of the pressure is absorbed by elasticity of the second spring 107. In such a state, although the stoppers 111 to 114 come into contact with the housing 102, most of the shock caused by the downward acting pressure is absorbed by the first and second springs 106 and 107, so that noise is rarely generated. As such, the present invention enables noise generated during the key-in operation to be remarkably reduced. Thereafter, when the pressure applied to the key cap is removed, the contracted rubber cup of the rubber cup unit 103 returns to an original shape thereof due to a restoring force. Therefore, the key top 100 returns to an original position thereof.

A key top 200 of the multiple key will be described below.

Figure 4A:
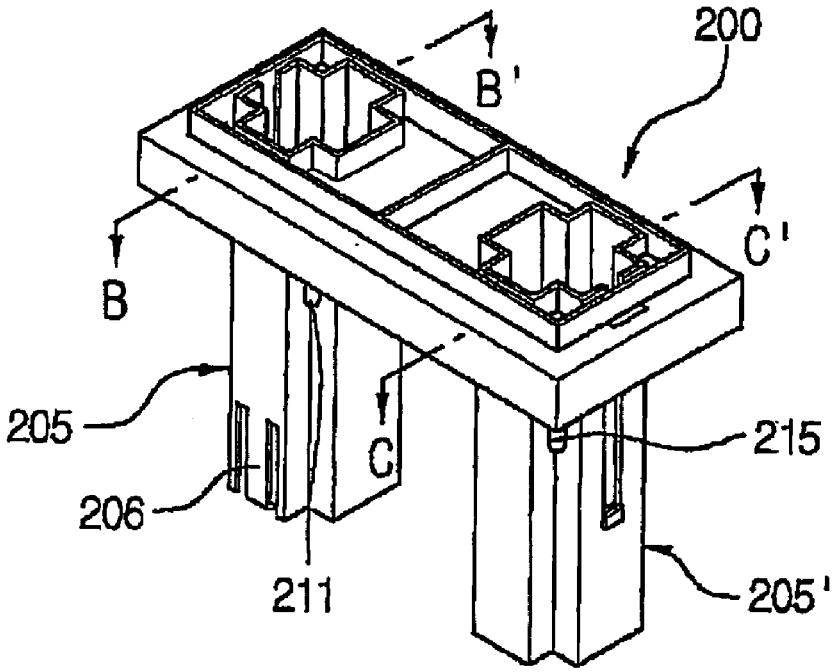
Figure 4B:
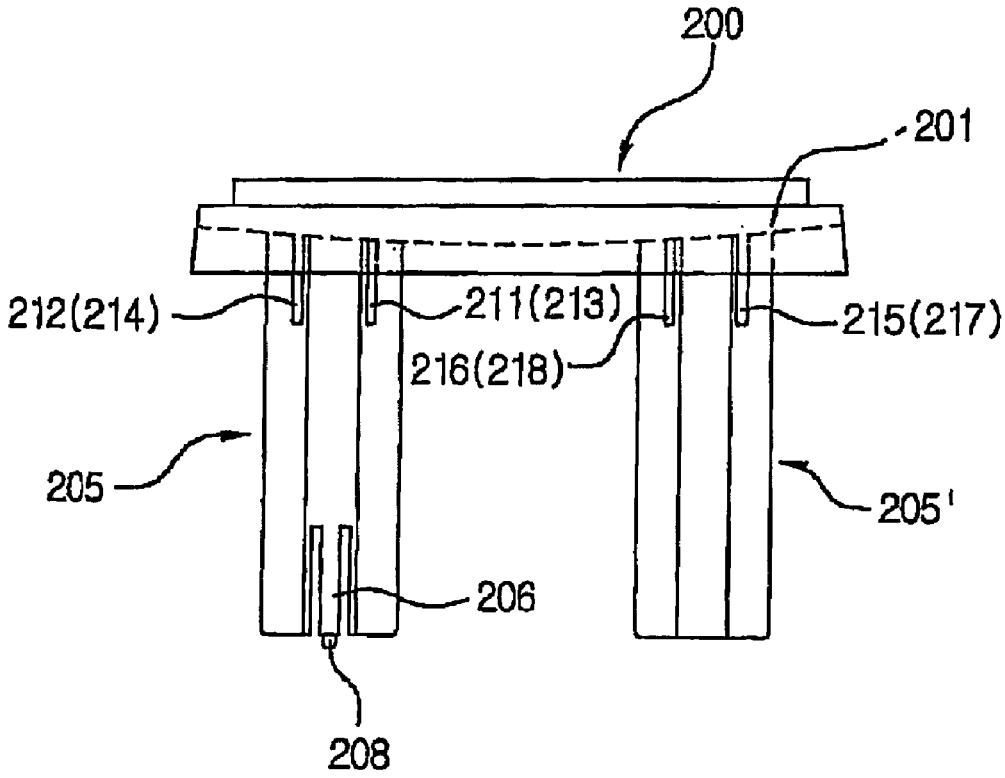
Figure 4C:
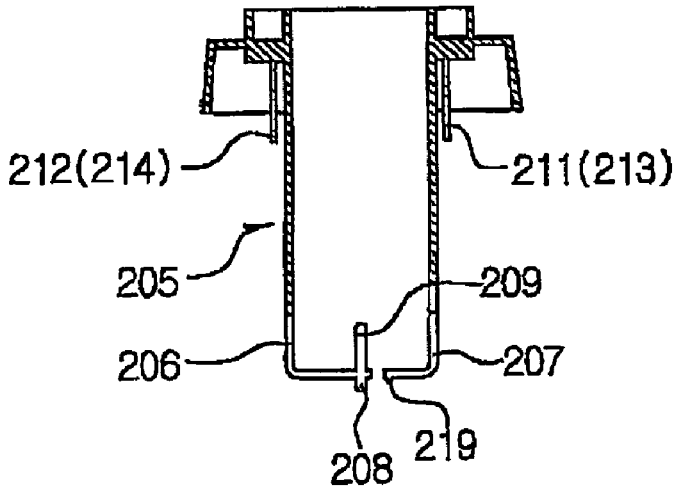
Figure 4D:
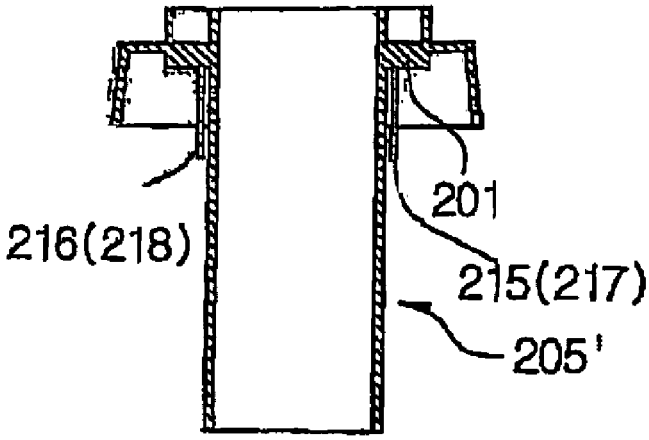
Figure 4E:
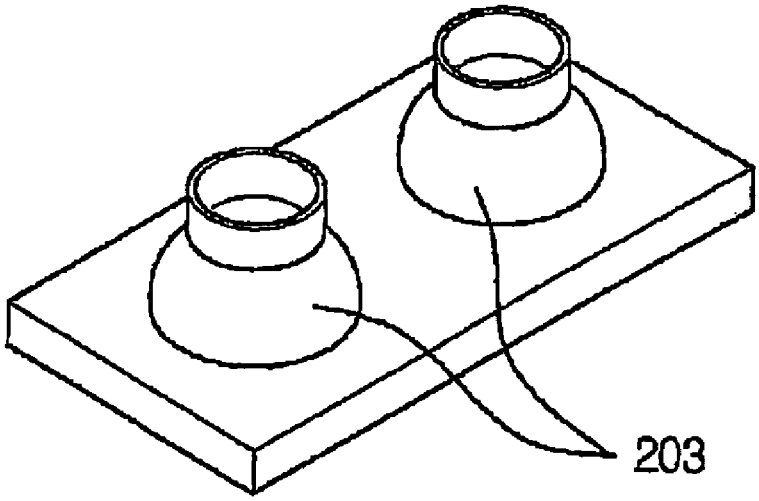
Figure 4F:
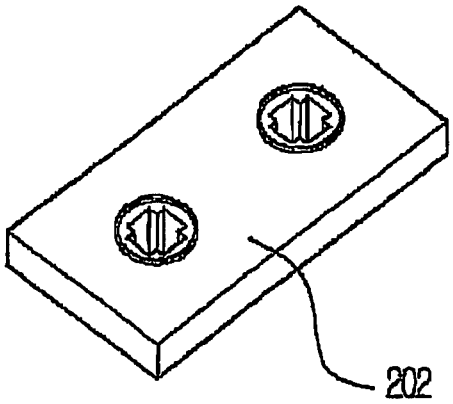
Figure 4G:
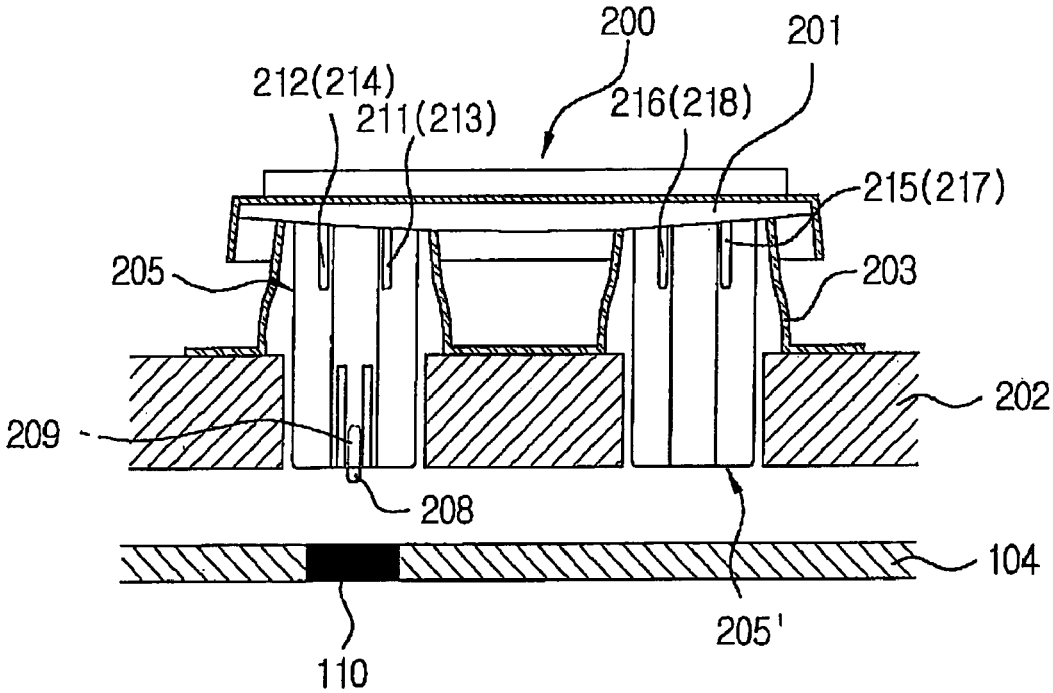
Figure 5A:
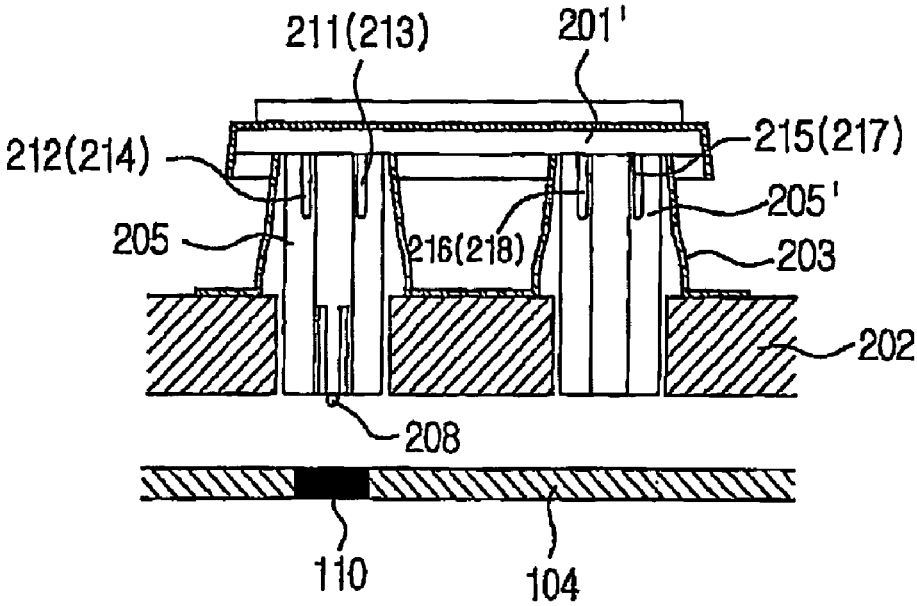
Figure 5B:
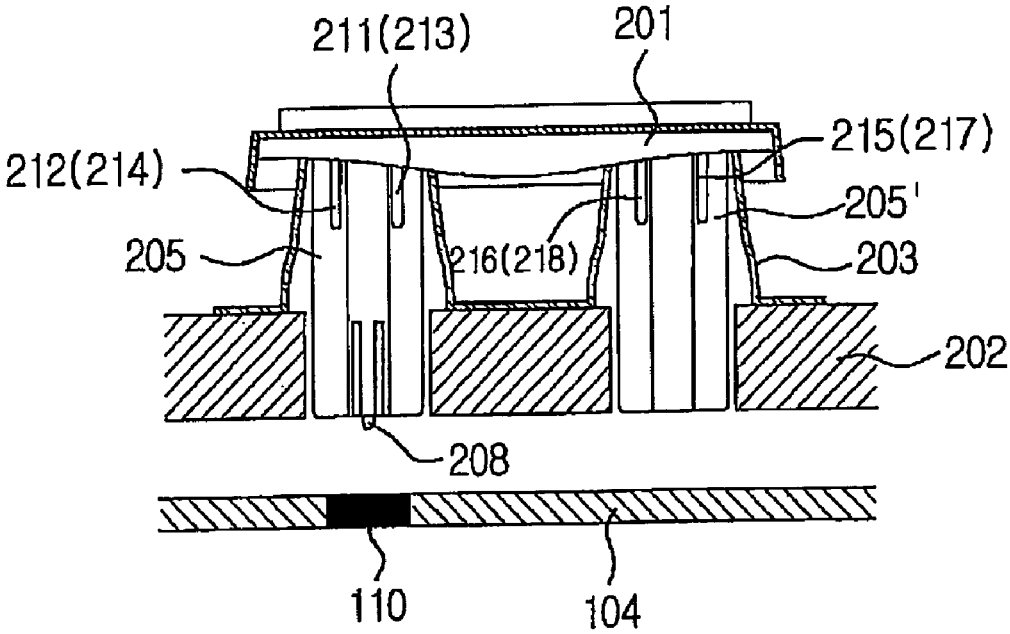
Figure 5C:
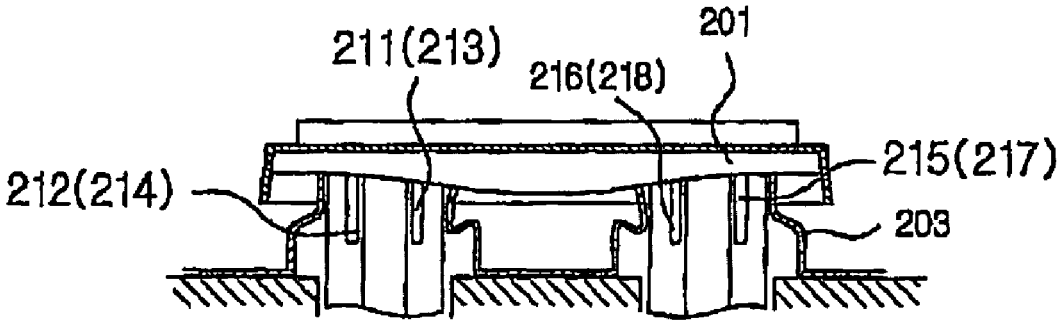
Figure 6A:
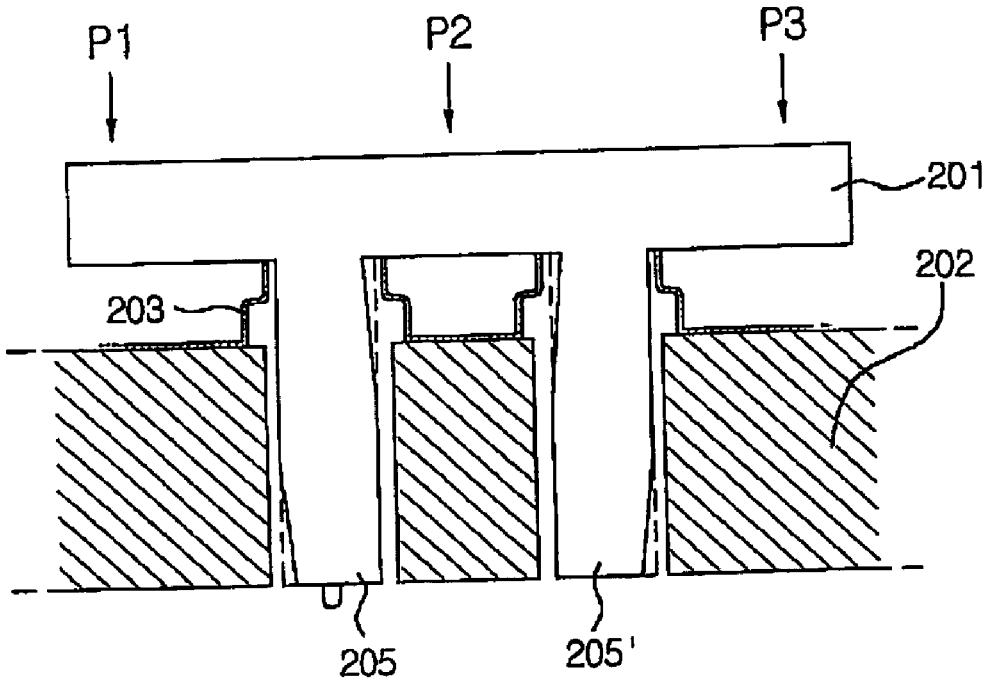
FIGS. 6*a* to 6*c* are views to show various shapes of first and second key stems.
Figure 6B:
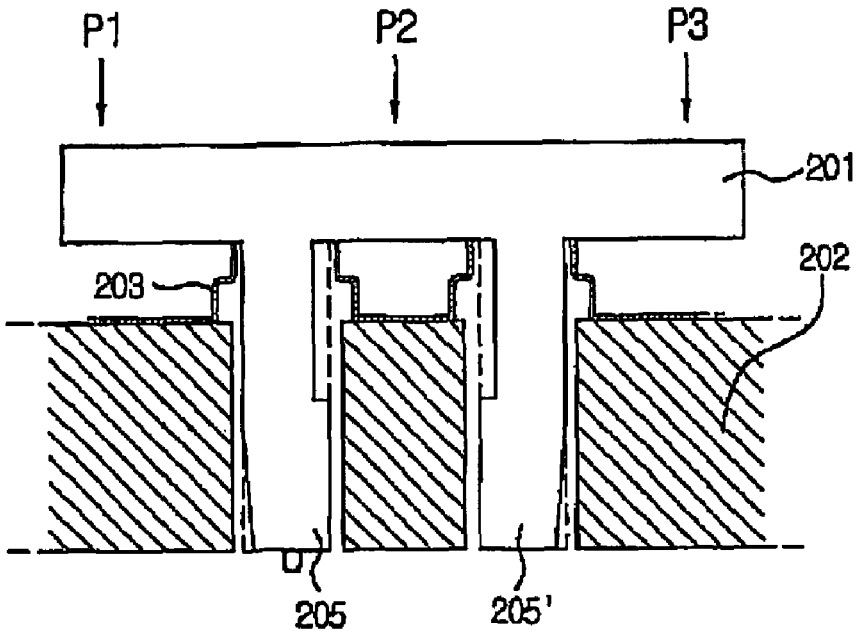
Figure 6C:
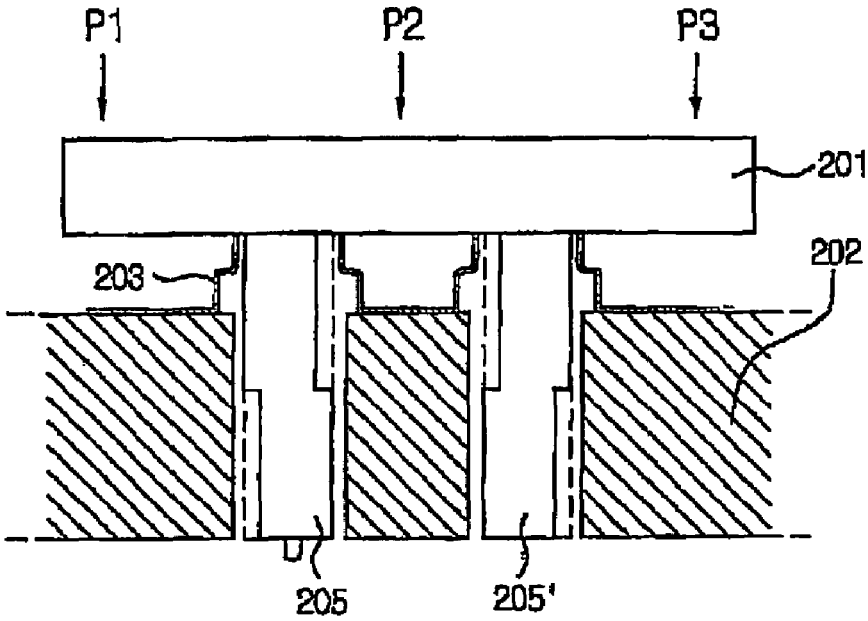
Figure 7:
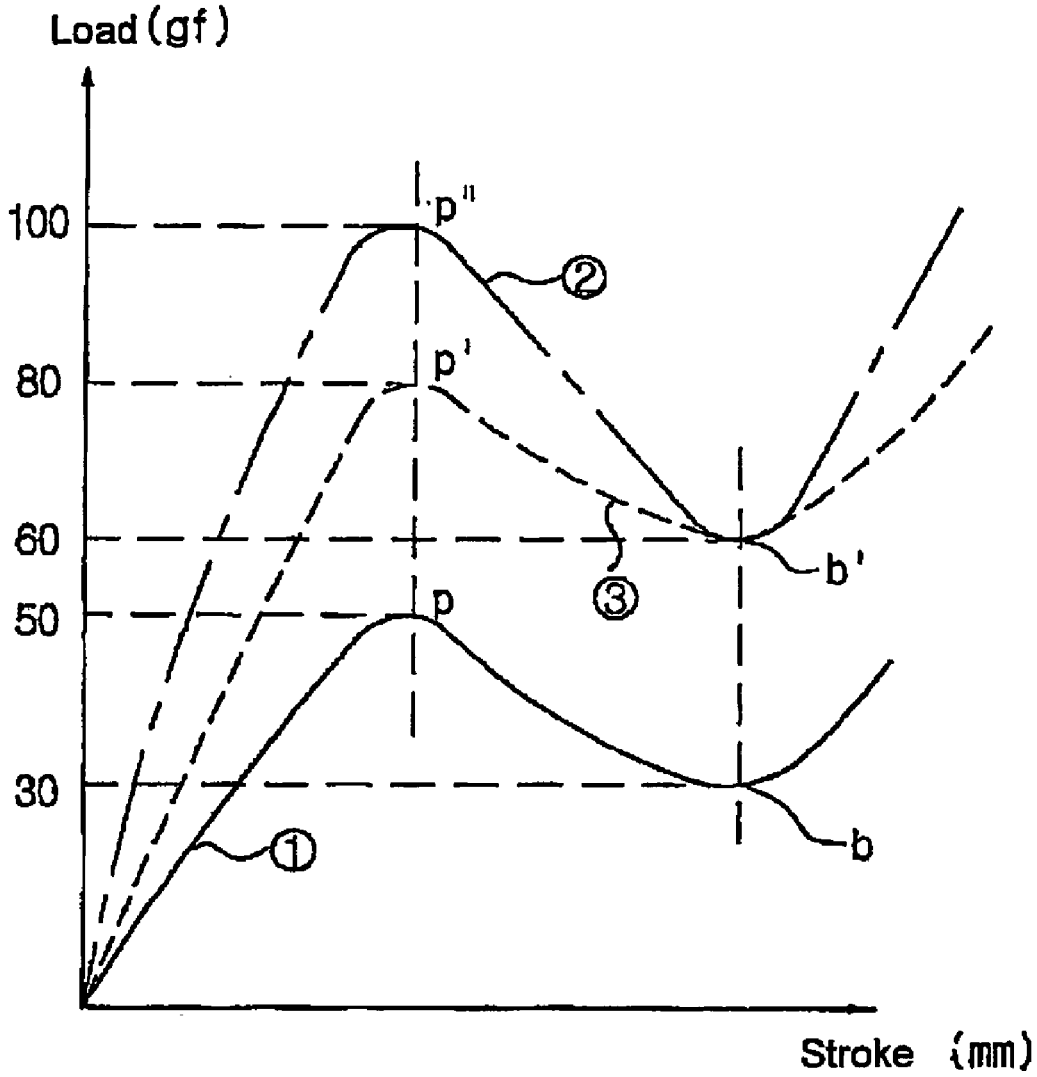
FIG. 7 is a graph to show the relationship between stroke and a load for the single key and the multiple key.

FIGS. 4*a* to 4*g* are views to show the key top of the multiple key, in which FIG. 4*a* is a perspective view of the key top, FIG. 4*b* is a front view of the key top, FIG. 4*c* is a sectional view taken along the line B–B' of FIG. 4*a*, FIG. 4*d* is a sectional view taken along the line C–C' of FIG. 4*a*, FIG. 4*e* is a perspective view of a rubber cup unit, FIG. 4*f* is a perspective view of a housing, and FIG. 4*g* is a sectional view to illustrate operation of the key top. FIGS. 5*a* to 5*c* are views to show contact surfaces of the key top of the multiple key, in which FIG. 5*a* is a sectional view to show the case where a lower portion of a center of a contact surface is flat, FIG. 5*b* is a sectional view to show the case where a lower portion of a center of a contact surface is downwardly convex, and FIG. 5*c* is a sectional view to illustrate the interaction between the contact surface and the rubber cup unit. FIGS. 6*a* to 6*c* are views to show various shapes of first and second key stems. Further, FIG. 7 is a graph to illustrate the pressing sensation of the multiple key.

In the multiple key, the key top 200 is constructed by combining two single keys with each other, as shown in FIGS. 4*a* to 4*g*.

The construction and shape of first and second key stems 205 and 205' included in the key top 200 of the multiple key will be described below. As shown in FIG. 4*b*, the construction of the first key stem 205 of the key top 200 of the multiple key remains the same as that of the key stem 105 of the key top 100 of the single key. On the other hand, the second key stem 205' is different from the key stem 105 of the key top 100 of the single key in that the second key stem 205' is not provided with first and second springs. That is, as shown in FIG. 4*d*, the second key stem 205' of the key top 200 extends downward from a contact surface 201, and has the shape of a box which is opened at a lower surface thereof.

According to the embodiment, the first and second key stems 205 and 205' have different constructions. However, without being limited to the embodiment, the first and second key stems 205 and 205' may have the same construction. That is, each of the first and second key stems 205 and 205' may include a first spring 206, a second spring 207, a first lower protrusion 208, and an upper protrusion 209.

Further, each of the first and second key stems 205 and 205' has a shape to smoothly move downward, with little frictional resistance, to an inside wall of a housing 202, when an operator presses any part of the key cap. That is, as shown in FIGS. 6*a* to 6*c*, each of the first and second key stems 205 and 205' is formed such that a lower portion of an outside surface thereof and an upper portion of an inside surface thereof are cut to be inclined, thus providing slanted surfaces. Alternatively, each of the first and second key stems 205 and 205' is formed such that the lower portion of the outside surface thereof and/or the upper portion of the inside surface thereof have steps.

A rubber cup unit 203 and the housing 202 of the multiple key will be described below. As shown in FIG. 4*e*, the rubber cup unit 203 includes two rubber cups to receive the second key stem 205' as well as the first key stem 205. The rubber cups of the rubber cup unit 203 comprise the same construction and material as those of the rubber cup of the rubber cup unit 103 of the key top 100. Further, the rubber cup unit 203 performs the same function as that of the rubber cup unit 103 of the key top 100. That is, a circular opening is formed at a predetermined position on the rubber cup unit 203 to allow the second key stem 205' to move through the rubber cup unit 203, and the hollow rubber cup integrally extends upward from a position around the circular opening. Further, an upper edge of the rubber cup is in contact with the contact surface 201.

Similarly, the housing 202 of the key top 200 has the same construction as the housing 102 of the key top 100, but has an additional opening to receive the second key stem 205'. The housing 202 of the key top 200 performs the same function as that of the housing 102 of the key top 100. In a detailed description, an additional opening is formed one an upper surface of the housing 202 to allow the key stem 205' of the key top 200 to move through the housing 202, and an inside wall of the housing 202 vertically extends downward from the opening.

Next, the contact surface 201 of the key top 200 of the multiple key will be described below. As shown in FIG. 5*b*, the contact surface 201 of the key top 200 is formed such that a center of a lower surface thereof is convex. When the rubber cup unit 203 is coupled to the contact surface 201, as shown in FIG. 5*c*, two rubber cups of the rubber cup unit 203 are slightly compressed toward a center of the key top 200 by the convex part of the contact surface 201. Thus, when an operator presses, a pressing sensation imparted to the operator is reduced. Thereby, although the key top 200 uses two rubber cups, the pressing sensation of the key top 200 is almost equal to that of the key top 100 using a single rubber cup. In FIGS. 5*b* and 5*c*, the convex part of the contact surface 201 and the compressed parts of the rubber cup unit 203 are emphasized for an easy understanding of this invention.

The examples where parts P1, P2, and P3 of the key cap are pressed down to execute the key-in operation will be described below.

As shown in FIG. 6*a*, when an operator presses down the part P2 of the key cap, the first and second key stems 205 and 205' move smoothly downward without coming into contact with the inside wall of the housing 202. However, when the operator presses down the part P3 of the key cap, the first key stem 205 which is positioned distant from the part P3 comes into contact with the inside wall of the housing 202. Due to frictional resistance resulting from contact between the first key stem 205 and the inside wall of the housing 202, the first key stem 205 may not move downward. Similarly, when the operator presses down the part P1 of the key cap, the second key stem 205' which is positioned distant from the part P1 comes into contact with the inside wall of the housing 202. Due to frictional resistance resulting from the contact between the second key stem 205' and the inside wall of the housing 202, the second key stem 205' may not move downward. In order to solve the problem, the first and second key stems 205 and 205' for the multiple key are shaped as shown in FIGS. 6*a* to 6*c*, thus maximally reducing frictional resistance, therefore allowing the first and second key stems 205 and 205' to move smoothly downward.

For example, as shown in FIG. 6*a*, the first and second key stems 205 and 205' are positioned to face each other. The lower portion of the outside surface of each of the first and second key stems 205 and 205' are cut to be inclined, thus providing the slanted surface. Further, the upper portion of the inside surface of each of the first and second key stems 205 and 205' is cut to be inclined, thus providing the slanted surface. Thus, even when an operator presses down the part P3 of the key cap, the first key stem 205 located distant from the part P3 moves smoothly downward without coming into contact with the inside wall of the housing 202. Similarly, even when the operator presses down the part P1 of the key cap, the second key stem 205' located distant from the part P1 moves smoothly downward without coming into contact with the inside wall of the housing 202.

According to another example, the first and second key stems 205 and 205' may be shaped as shown in FIG. 6*b*. That is, the lower portion of the outside surface of each of the first and second key stems 205 and 205' are cut to be inclined, thus providing a slanted surface. Further, the upper portion of the inside surface of each of the first and second key stems 205 and 205' are cut to form a step. Moreover, as shown in FIG. 6*c*, the lower portion of the outside surface and the upper portion of the inside surface of each of the first and second key stems 205 and 205' may be cut to form steps.

The operation of the key top 200 of the multiple key will be described with reference to FIG. 4*g*.

When an operator presses down the key cap (not shown), finger pressure is transmitted from the key cap through the contact surface 201 of the key top 200 to the rubber cups of the rubber cup unit 203. At this time, the rubber cups of the rubber cup unit 203 are slightly compressed by the convex part of the contact surface 201, so that the operator has only to press using the same amount of pressure as for a single key. The key top 200 moves downward by the finger pressure, so that the first lower protrusion 208 comes into contact with the contact point 110 of the FPC 104, thus executing the key-in operation. When the key-in operation is executed, part of the pressure is absorbed by the elasticity of the first spring 206. Subsequently, a second lower protrusion 219 of the second spring 207 comes into contact with the FPC 104, so that the rest of the pressure is absorbed by the elasticity of the second spring 207. In such a state, although stoppers 211 to 218 come into contact with the housing 202, most of the shock resulting from the finger pressure is already absorbed by the elasticity of the first and second springs 206 and 207, so that noise is rarely generated. As such, the present invention remarkably reduces noise generated during the key-in operation. Thereafter, when the key cap is released, the contracted rubber cups of the rubber cup unit 203 are elastically restored to original shapes thereof, and thus the key top 200 is returned to an original position thereof.

When an operator presses the single key or the multiple key according to the present invention, the pressing sensation imparted to the operator will be described below.

FIG. 7 is a graph to show the relationship between stroke and a load for a single key and a multiple key. The curved line ① shows the pressing sensation for a single key, and the curved line ② shows the pressing sensation for a multiple key constructed by combining two single keys with each other, and the curved line ③ shows the pressing sensation for the multiple key according to the present invention. That is, the curved line ② shows the case where the contact surface 201' of the multiple key is flat as shown in FIG. 5*a*, like the contact surface 101 of the single key. Further, the curved line ③ shows the case where the center of the lower surface of the contact surface 201 is convex, as shown in FIG. 5*b*. The X-axis designates the stroke, while the Y-axis designates the load. In this case, the stroke is defined as a moving distance of the key top, when an operator presses down the key top to move the key top downward from an upper dead point, and the stroke is measured in millimeters (mm). The load is defined as resistance to the downward force when the key top moves downward, and measured in gf.

In the curved line ①, p designates a peak load, while b designates a floor load. The pressing sensation realized by the operator is the value (p-b) obtained by subtracting the floor load from the peak load, that is, 20*gf*.

Further, in the curved line ②, the pressing sensation realized by the operator is the value (p"-b') obtained by subtracting the floor load from the peak load, that is, 0*gf*. That is, the pressing sensation for the multiple key constructed by combining two single keys is twice the pressing sensation for the single key. If the difference of the pressing sensation between the single key and the multiple key is large, the operator feels a different pressing sensation between single keys and multiple keys on the same keyboard. Thus, the pressing sensation realized by the operator when pressing a multiple key is about twice the pressing sensation realized by the operator when pressing the single key, so that it is uncomfortable to use. Moreover, when the operator presses the multiple key with the same amount of pressure for a single key, the key-in operation may not be carried out.

However, in the curved line ③, the pressing sensation realized by the operator is the value (p'-b') obtained by subtracting the floor load from the peak load, that is, 20*gf*. In a detailed description, since the convex part of the contact surface 201 of the multiple key is assembled to slightly compress the rubber cup unit 203, the peak load of the rubber cup unit 203 decreases, so that the pressing sensation for the multiple key is almost equal to the pressing sensation for a single key. That is, the pressing sensation realized by the operator when pressing a multiple key is almost equal to the pressing sensation realized by the operator when pressing a single key. Thus, even when the operator presses a multiple key, the multiple key is equal to the single key in pressing sensation, thus ensuring comfortable use of the keyboard. Further, although the operator presses the multiple key with the same amount of pressure for a single key, the key-in operation is smoothly executed.

According to this embodiment, two key stems are provided on the key top of the multiple key. However, without being limited to the embodiment, two or more key stems may be provided, according to the size of the multiple key.

As described above, the present invention provides a key top, which reduces noise compared to a conventional key top, and allows key-in operation using a multiple key to be smoothly executed, and allows a single key and a multiple key to impart an identical pressing sensation, although identical rubber cups are used in the single key and the multiple key.

Compared to the conventional key top, the advantages of the key top according to the present invention will be described below.

According to a first aspect of the present invention, the construction of the key top is simple. First and second springs are integrally provided on a key stem of the key top, and the same rubber cup is used for the single key and the multiple key, so that the key top of this invention has a very simple construction.

According to a second aspect of the present invention, the sound of the key top is quiet. Although stoppers of the key top of this invention come into contact with a housing, a shock acting on the key top is absorbed by elasticity of the first and second springs, thus markedly reducing noise generated during key-in operation.

According to a third aspect of the present invention, key stems of the multiple key smoothly execute key-in operation. According to the present invention, the plurality of key stems of the multiple key is cut to be inclined at lower portions of outside surfaces and upper portions of inside surfaces of the key stems, thus forming slanted surfaces. Thereby, friction between the key stems and inside walls of the housing is minimized, thus allowing the key stems to smoothly move downward and execute key-in operation.

According to a fourth aspect of the present invention, the same degree of pressing sensation can be achieved for the single key and the multiple key. That is, a contact surface of the key top is formed to be convex at a center of a lower surface thereof, so that inside portions of rubber cups provided on both sides of a rubber cup unit are compressed by the convex part of the contact surface. Therefore, the peak load of the rubber cup unit decreases, so that the pressing sensation for the multiple key is equal to the pressing sensation for the single key.

What is claimed is:

1. A key top, comprising:

a key stem provided at a lower portion of the key top to be inserted into a rubber cup unit;

a first spring provided at a lower end of the key stem, and comprising a plate spring, wherein the key top is pushed down by finger pressure to cause the first spring to touch and turn on a contact point, thus executing key-in operation;

a second spring provided at the lower end of the key stem, and comprising a plate spring;

and a protrusion provided at a lower end of the second spring to correspond to the contact point.

2. The key top according to claim 1, wherein the first and second springs are placed to face each other horizontally and separately.

3. The key top according to claim 1, wherein the protrusion provided at the lower end of the second spring touches the contact point subsequently to the first spring when the key top is pushed down by the finger pressure, whereby a shock caused by the finger pressure is absorbed by the first and second spring, contributing to noise reduction.

4. A key top, comprising:

a key stem provided at a lower portion of the key top to be inserted into a rubber cup unit; and a first spring provided at a lower end of the key stem, and comprising a plate spring, wherein the key top is pushed down by finger pressure to cause the first spring to touch and turn on a contact point, thus executing key-in operation, wherein the key stem comprises a plurality of key stems, so that the key top is used for multiple keys, and a lower surface of the key top comprises a slanted surface, thus applying non-uniform pressure to the rubber cup unit in an initial state.

5. A key top, comprising:

a key stem provided at a lower portion of the key top to be inserted into a rubber cup unit; and a first spring provided at a lower end of the key stem, and comprising a plate spring, wherein the key top is pushed down by finger pressure to cause the first spring to touch and turn on a contact point, thus executing key-in operation, wherein the key stem comprises a plurality of key stems, so that the key top is used for multiple keys, and each of the key stems is recessed at an inside surface of an upper end and an outside surface of a lower end thereof.

6. The key top according to claim 5, wherein at least one of the inside surface and the outside surface of each of the key stems is formed to be inclined.

7. The key top according to claim 6, wherein at least one of the inside surface and the outside surface of each of the key stems is formed to provide a step.

* * * * *